US008215281B1

(12) United States Patent
Holden

(10) Patent No.: US 8,215,281 B1
(45) Date of Patent: Jul. 10, 2012

(54) PISTON ASSEMBLY

(76) Inventor: Thomas Edwin Holden, Brookings, OR (US)

( * ) Notice: Subject to any disclaimer, the term of this patent is extended or adjusted under 35 U.S.C. 154(b) by 546 days.

(21) Appl. No.: 12/542,984

(22) Filed: Aug. 18, 2009

Related U.S. Application Data

(60) Provisional application No. 61/215,645, filed on May 7, 2009.

(51) Int. Cl.
*F02B 75/32* (2006.01)

(52) U.S. Cl. ..... 123/197.4; 74/579 E

(58) Field of Classification Search .... 123/197.1–197.4; 74/579 R, 579 E
See application file for complete search history.

(56) References Cited

U.S. PATENT DOCUMENTS

| | | | | |
|---|---|---|---|---|
| 2,096,562 | A | 10/1937 | Sarfaty | |
| 2,821,445 | A | 1/1958 | Gardner | |
| 3,693,463 | A | 9/1972 | Garman | |
| 4,802,382 | A | 2/1989 | Nissels | |
| 5,245,962 | A | 9/1993 | Routery | |
| 6,966,283 | B2 | 11/2005 | Beshore | |
| 7,255,071 | B2 | 8/2007 | Beshore | |
| 7,814,881 | B2 * | 10/2010 | McRae | 123/197.4 |
| 7,909,012 | B2 * | 3/2011 | Pattakos et al. | 123/197.4 |

* cited by examiner

*Primary Examiner* — Noah Kamen
(74) *Attorney, Agent, or Firm* — Jerry Haynes Law

(57) ABSTRACT

A piston assembly includes a piston comprising a piston base and a piston head spaced-apart from the piston base and a crankshaft between the piston head and the piston base and connected to the piston base.

11 Claims, 3 Drawing Sheets

PISTON ASSEMBLY

CROSS-REFERENCE TO RELATED APPLICATIONS

This application claims the benefit of and incorporates by reference in its entirety U.S. provisional application No. 61/215,645, filed May 7, 2009 and entitled "Piston/wrist pin separation to reverse piston travel speed, lengthening combustion time and volume for complete fuel burn".

FIELD OF THE INVENTION

The present disclosure relates to internal combustion engines. More particularly, the present disclosure relates to a piston assembly for an internal combustion engine in which combustion time and volume for complete fuel burn are increased.

BACKGROUND OF THE INVENTION

An exemplary conventional piston assembly for an internal combustion engine is generally indicated by reference numeral 1 in FIGS. 1 and 5. As illustrated in FIG. 5, the conventional piston assembly 1 includes a cylinder 2 having a cylinder interior 3. A piston head 6 having a combustion surface 7 is disposed in the cylinder interior 3 for reciprocation therein during a combustion cycle. A combustion chamber 4 is defined in the cylinder interior 3 between the walls of the cylinder 2 and the combustion surface 7 of the piston head 6. An elongated connecting rod 12 has a piston connecting end 16 which is pivotally attached to the piston head 6 via a wrist pin 15 and a crankshaft connecting end 13 which is opposite the piston connecting end 16. A crankshaft 18 includes a crankshaft body 19 and a crankshaft lobe 20 extending from the crankshaft body 19. The crankshaft lobe 20 of the crankshaft 18 is rotatably attached to the crankshaft connecting end 13 of the connecting rod 12 via a connecting pin 14. Reciprocation of the piston head 6 in the cylinder interior 3 of the cylinder 2 throughout the combustion cycle causes the connecting rod 12 to rotate the crankshaft 18 about a crankshaft axis of rotation 22.

The point of attachment between the piston head 6 and the connecting rod 12 at the wrist pin 15 is on the side of the crankshaft axis of rotation 22 which is proximate or nearer to the combustion surface 7 of the piston head 6. Consequently, as the reciprocating piston head 6 travels from the top-dead-center (TDC) position (the left-hand diagram in FIG. 5) to 90 degrees after TDC (the middle diagram in FIG. 5) in the cylinder interior 3 during the first half of the power stroke, the connecting pin 14 traverses the top or proximal arc of rotation, or the arc of rotation which is nearer or proximal to the combustion surface 7. Conversely, as the piston head 6 travels from 90 degrees after TDC (the middle diagram in FIG. 5) to the bottom-dead-center (BDC) position (the right-hand diagram in FIG. 5) during the second half of the power stroke, the connecting pin 14 traverses the bottom or distal arc of rotation, or the arc of rotation which is further from or distal to the combustion surface 7 of the piston head 6. As a result, the distance of travel of the piston head 6 from the TDC position to 90 degrees after TDC in the cylinder interior 3 is greater than the distance of travel of the piston head 6 from 90 degrees after TDC to the BDC position. This longer distance of travel of the piston head 6 during the first half relative to the second half of the power stroke results in incomplete combustion of fuel in the cylinder interior 3 throughout the combustion cycle.

Accordingly, a piston assembly is needed in which the distance of travel of the piston head from the TDC position to 90 degrees after TDC (the first half of the power stroke) is less than the distance of travel of the piston head from 90 degrees after TDC to the BDC position (the second half of the power stroke) to increase combustion time and provide a more constant volume for substantially complete fuel consumption during the initial part of the power stroke in an internal combustion engine.

SUMMARY OF THE INVENTION

The present disclosure is generally directed to a piston assembly. An illustrative embodiment of the piston assembly includes a piston comprising a piston base and a piston head spaced-apart from the piston base and a crankshaft between the piston head and the piston base and connected to the piston base.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Figure 2:
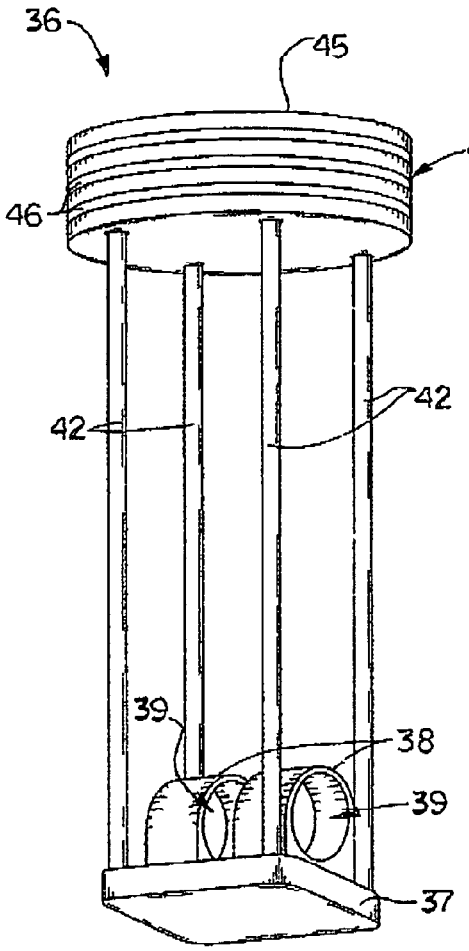
FIG. 2 is a perspective view of a piston of an illustrative embodiment of the piston assembly of the present disclosure.
Figure 3:
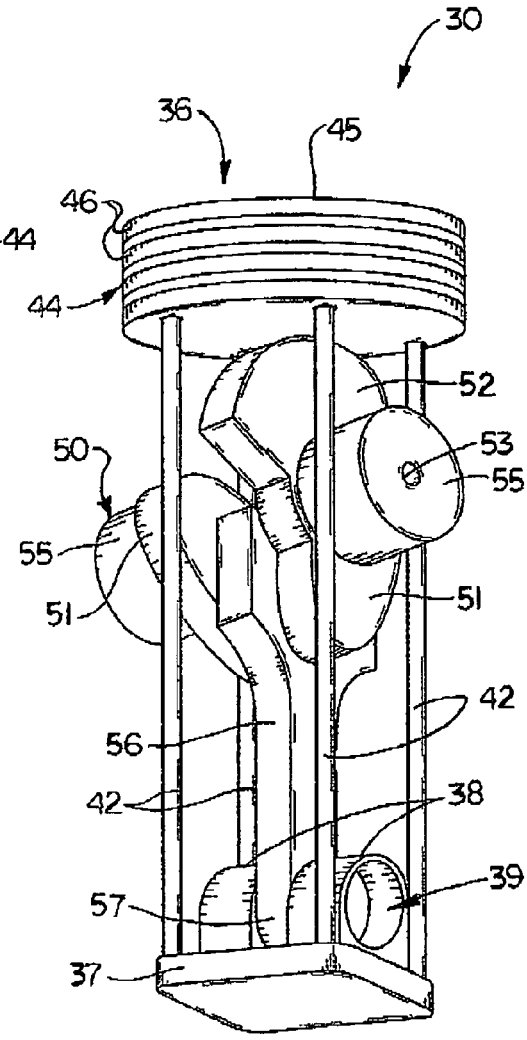
FIG. 3 is a perspective view of an illustrative embodiment of the piston assembly.
Figure 6:
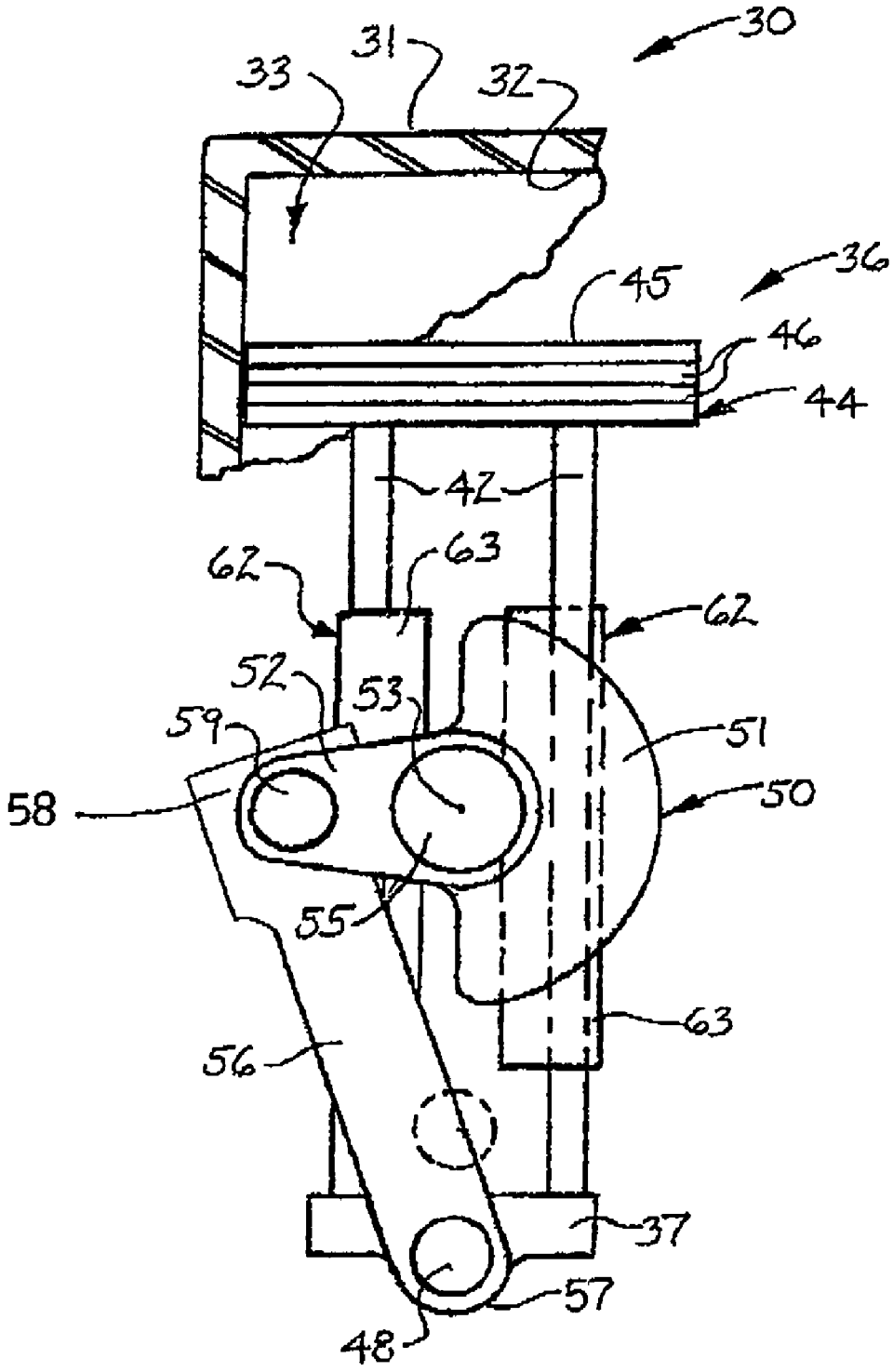
FIG. 6 is a side view of an alternative illustrative embodiment of the piston assembly, with a crankshaft bearing block provided on each spacer rod of the piston.

Referring to FIGS. 2, 3 and 6 of the drawings, an illustrative embodiment of a piston assembly is generally indicated by reference numeral 30 in FIGS. 3 and 6. The piston assembly 30 may be a single piston assembly or one of multiple piston assemblies in an internal combustion engine. The piston assembly 30 may include a cylinder 31 having a cylinder interior 32. A piston 36 of the piston assembly 30 is reciprocally mounted in the cylinder interior 32 of the cylinder 31. As illustrated in FIG. 2, the piston 36 of the piston assembly 30 may include a piston base 37 on which is provided a pair of spaced-apart base flanges 38. A pin opening 39 may extend through each base flange 38 for purposes which will be hereinafter described.

At least one and typically multiple elongated spacer rods 42 may extend from the piston base 37 in spaced-apart relationship with respect to each other. A piston head 44 having a combustion surface 45 may be provided on the spacer rods 42 in spaced-apart relationship with respect to the piston base 37. As illustrated in FIG. 6, when the piston 36 is reciprocally mounted in the cylinder interior 32 of the cylinder 31, a combustion chamber 33 is defined in the cylinder interior 32 between the combustion surface 45 of the of the piston head 44 and the wall of the cylinder 31. Multiple piston rings 46 may be provided on the piston head 44 to provide a seal between the piston head 44 and the interior surface of the cylinder 31, as is known by those skilled in the art. Fuel intake and exhaust outlet valves (not illustrated) may be provided at the combustion chamber 33 end of the cylinder 31 for the introduction of fuel and evacuation of exhaust from the combustion chamber 33, respectively, as is known by those skilled in the art.

A crankshaft 50 is attached to the piston 36 via a connecting rod 56. The crankshaft 50 may have a crankshaft body 51. A crankshaft lobe 52 may extend from the crankshaft body 51. Connecting shafts 55 may connect adjacent crankshaft bodies 51 to each other in the crankshaft 50. The crankshaft 50 is adapted to rotate about a crankshaft axis of rotation 53 throughout reciprocation of the piston 36 in the cylinder interior 32 during a combustion cycle, as will be hereinafter described. The connecting rod 56 may have a piston connecting end 57 which is rotatably attached to the piston base 37 of the piston 36 via a wrist pin 48 (FIG. 6). The wrist pin 48 may be extended through the pin openings 39 (FIGS. 2 and 3) provided in the base flanges 38. A crankshaft connecting end 58 is opposite the piston connecting end 57 of the connecting rod 56 and is rotatably attached to the crankshaft lobe 52 of the crankshaft 50 via a connecting pin 59 (FIG. 6). The point of attachment of the connecting rod 56 with the piston 36 at the wrist pin 48 may be on the side of the crankshaft axis of rotation 53 (FIG. 6) which is distal to or further from the combustion surface 45 on the piston head 44 of the piston 36. In FIG. 6, the piston 36 is shown at 90 degrees after TDC. As the piston 36 travels from TDC to 90 degrees after TDC (FIG. 6) in the combustion chamber 33 during the first half of the power stroke of the piston 36, the connecting pin 59 traverses the bottom or distal arc of rotation, or the arc of rotation which is distal to or further from the piston head 44 (distal arc of rotation). Consequently, the distance of travel of the piston head 44 from TDC to 90 degrees after TDC is smaller than the distance of travel of the piston head 44 from 90 degrees after TDC to BDC.

In typical application, the piston assembly 30 may be a single piston assembly in a small internal combustion engine (not illustrated) or may be one of multiple piston assemblies 30 in a multi-cylinder internal combustion engine. Moreover, the multiple piston assemblies 30 may be arranged in a straight configuration, a V-configuration, a flat or horizontally-opposed configuration or any other desirable configuration which is suitable for the purpose. The cylinder 31 (FIG. 6) of each piston assembly 30 may be fitted with injection and exhaust valves, spark plugs, electronic fuel injection components and/or other components which are necessary for the introduction of a fuel/air mixture into the combustion chamber 33 and combustion of the fuel, as well as evacuation of the exhaust from the combustion chamber 33, according to the knowledge of those skilled in the art. The crankshaft 50 may be coupled to a flywheel (not illustrated) for automotive applications or other element or component depending on the desired application.

As a fuel/air mixture is ignited in the combustion chamber 33, the piston 36 commences the power stroke phase of the combustion cycle and travels from TDC to 90 degrees after TDC (FIG. 6). At the 90 degrees after TDC position, the longitudinal axis of the crankshaft lobe 52 of the crankshaft 50 is oriented at 90 degrees with respect to a longitudinal axis of the cylinder 31. During this transition of the piston 36, the connecting pin 59 between the crankshaft 50 and the connecting rod 56 traverses the bottom or distal arc of rotation of the crankshaft 50. As the piston 36 next continues to travel from 90 degrees after TDC to BDC (FIG. 3) and back to TDC, the connecting pin 59 completes rotation. Consequently, during each combustion cycle, the combustion volume of chamber 33 fluctuates less during the combustion period and therefore, substantially all of the fuel which is introduced into the combustion chamber 33 is consumed, resulting in an efficient power stroke of the piston 36 as well as emission of clean exhaust from the internal combustion engine of which the piston assembly 30 is a part.

Figure 1:
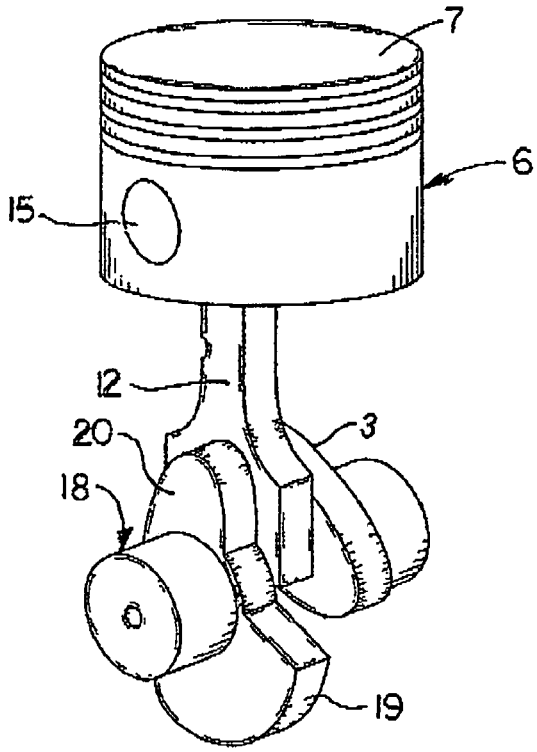
FIG. 1 (PRIOR ART)
FIG. 1 is a perspective view of a piston head, connecting rod and crankshaft of an exemplary conventional piston assembly of an internal combustion engine.
Figure 4:
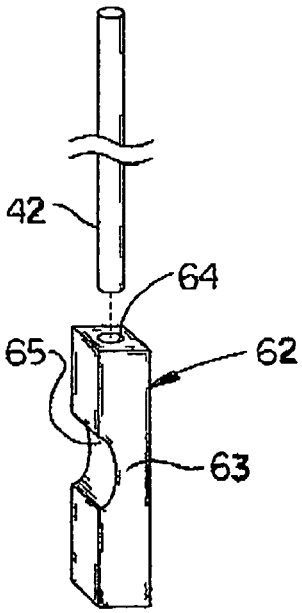
FIG. 4 is an exploded perspective view of a crankshaft bearing which is suitable for implementation of an illustrative embodiment of the piston assembly.
Figure 5:
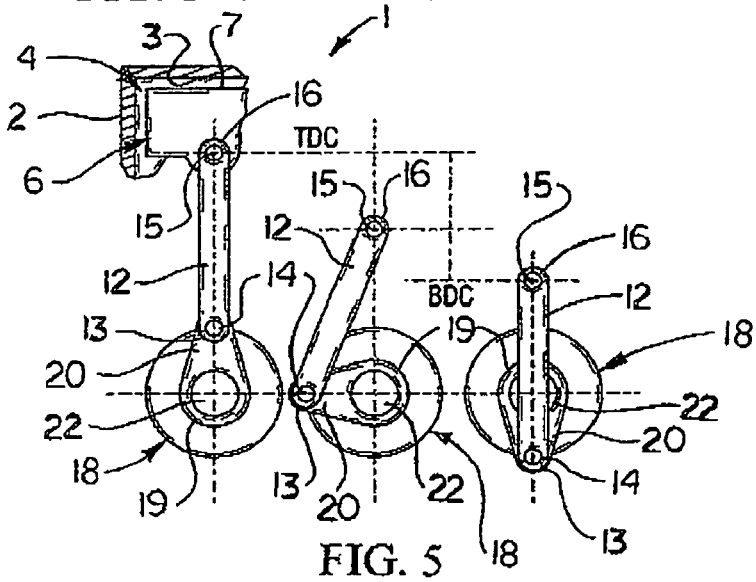
FIG. 5 (PRIOR ART)
FIG. 5 illustrates side views of a piston of a conventional piston assembly at top dead center, 90-degrees after top dead center and bottom dead center positions, respectively, of the piston.

Referring next to FIGS. 4 and 6 of the drawings, in some illustrative embodiments of the piston assembly 36, a crankshaft bearing 62 may be provided on each spacer rod 42 of the piston 36. As illustrated in FIG. 4, each crankshaft bearing 62 may include a generally elongated bearing block 63. A rod opening 64 may extend through the longitudinal dimension of the bearing block 63 to receive the corresponding spacer rod 42 of the piston 36. A generally concave shaft cavity 65 may be provided in a side surface of the bearing block 63. Accordingly, as illustrated in FIG. 6, a pair of crankshaft bearings 62 may be mounted on a respective pair of the spacer rods 42 with the shaft cavities 65 (FIG. 4) of the crankshaft bearings 62 facing each other. A connecting shaft 55 of the crankshaft 50 may extend through the opposing shaft cavities 65 of the respective crankshaft bearings 62. Therefore, the inner surfaces of the respective shaft cavities 65 provide a bearing surface for the connecting shaft 55 of the crankshaft 50 as the piston 36 rotates the crankshaft 50 about the crankshaft axis of rotation 53 (FIG. 9).

While illustrative embodiments of the disclosure have been described above, it will be recognized and understood that various modifications can be made and the appended claims are intended to cover all such modifications which may fall within the spirit and scope of the disclosure.

What is claimed is:

1. A piston assembly, comprising:

a piston comprising a piston base and a piston head spaced-apart from the piston base;

a crankshaft between the piston head and the piston base and connected to the piston base;

at least one spacer rod extending between the piston base and the piston head of the piston; and at least one crankshaft bearing provided on the at least one spacer rod and engaging the crankshaft.

2. The piston assembly of claim 1 wherein the at least one spacer rod comprises a plurality of spacer rods.

3. The piston assembly of claim 1 further comprising a connecting rod connecting the crankshaft and the piston base of the piston.

4. The piston assembly of claim 3 wherein the connecting rod comprises a crankshaft connecting end rotatably coupled to the crankshaft and a piston connecting end opposite the crankshaft connecting end and rotatably coupled to the piston base of the piston.

5. The piston assembly of claim 3 further comprising a pair of base flanges provided on the piston base and wherein the connecting rod is connected to the pair of base flanges.

6. The piston assembly of claim 1 wherein the crankshaft comprises a crankshaft body and a crankshaft lobe extending from the crankshaft body and connected to the piston base.

7. The piston assembly of claim 6 further comprising a connecting rod having a crankshaft connecting end connected to the crankshaft lobe of the crankshaft and a piston connecting end connected to the piston base of the piston.

8. A piston assembly, comprising:

a cylinder having a cylinder interior;

a piston having a combustion surface reciprocally disposed in the cylinder interior and positional between a top-dead-center position, a 90 degrees past top-dead-center position and a bottom-dead-center positions;

wherein the piston comprises a piston base and a piston head spaced-apart from the piston head, and wherein the piston connecting end of the connecting rod is coupled to the piston base, and the piston assembly further comprising at least one spacer rod extending between the piston base and the piston head of the piston;

wherein the at least one spacer rod comprises a plurality of spacer rods, and the piston assembly comprises a plurality of crankshaft bearings provided on the plurality of spacer rods, respectively, and engaging the crankshaft;

a crankshaft rotatable about a crankshaft axis of rotation;

a combustion chamber defined between the cylinder and the piston;

a connecting rod having a crankshaft connecting end coupled to the crankshaft and a piston connecting end coupled to the piston on a distal side of the crankshaft axis of rotation relative to the combustion chamber;

wherein the crankshaft connecting end of the crankshaft is adapted to traverse a distal arc of rotation relative to the combustion chamber as the piston travels from the top-dead-center position to the 90 degrees past top-dead-center position; and wherein a distance of travel of the piston from the top-dead-center position to the 90 degrees past top-dead-center position is less than a distance of travel of the piston from the 90 degrees past top-dead-center position to the bottom-dead-center position.

9. The piston assembly of claim 8 further comprising a pair of base flanges provided on the piston base and wherein the piston connecting end of the connecting rod is connected to the pair of base flanges.

10. A piston assembly, comprising:

a cylinder having a cylinder interior;

a piston reciprocally disposed in the cylinder interior between a top-dead-center position, a 90 degrees past top-dead-center position and a bottom-dead-center position;

wherein the piston comprises a piston base and a piston head spaced-apart from the piston base;

a combustion chamber defined between the cylinder and the piston head of the piston;

a crankshaft provided between the piston base and the piston head of the piston and rotatable about a crankshaft axis of rotation and having a crankshaft body, and a crankshaft lobe extending from the crankshaft body and a connecting shaft extending from the crankshaft body;

a connecting rod having a crankshaft connecting end coupled to the crankshaft lobe of the crankshaft and a piston connecting end coupled to the piston base of the piston on a distal side of the crankshaft axis of rotation relative to the combustion chamber;

at least one spacer rod connecting the piston head to the piston base of the piston, wherein the at least one spacer rod comprises a plurality of spacer rods;

a plurality of crankshaft bearings provided on the plurality of spacer rods, respectively, and engaging the connecting shaft of the crankshaft;

wherein the crankshaft connecting end of the crankshaft is adapted to traverse a distal arc of rotation relative to the combustion chamber as the piston travels from the top-dead-center position to the 90 degrees past top-dead-center position and wherein a distance of travel of the piston from the top-dead-center position to the 90 degrees past top-dead-center position is less than a distance of travel of the piston from the 90 degrees past top-dead-center position to the bottom-dead-center position.

11. The piston assembly of claim 10 further comprising a pair of base flanges provided on the piston base and wherein the piston connecting end of the connecting rod is connected to the pair of base flanges.

* * * * *